US012484703B2

(12) United States Patent
Luo

(10) Patent No.: US 12,484,703 B2
(45) Date of Patent: Dec. 2, 2025

(54) MULTIFUNCTIONAL BED

(71) Applicant: Shenzhen Meiya Industrial Development Co., Ltd., Shenzhen (CN)

(72) Inventor: Honglang Luo, Shenzhen (CN)

(73) Assignee: Shenzhen Meiya Industrial Development Co., Ltd., Shenzhen (CN)

( * ) Notice: Subject to any disclaimer, the term of this patent is extended or adjusted under 35 U.S.C. 154(b) by 262 days.

(21) Appl. No.: 18/313,329

(22) Filed: May 6, 2023

(65) Prior Publication Data

US 2024/0341489 A1 Oct. 17, 2024

(30) Foreign Application Priority Data

Apr. 17, 2023 (CN) ..... 202310433383.0

(51) Int. Cl.
*A47C 17/86* (2006.01)
*A47C 19/02* (2006.01)

(52) U.S. Cl.
CPC ..... *A47C 17/86* (2013.01); *A47C 19/022* (2013.01)

(58) Field of Classification Search
CPC ..... A47C 17/86; A47C 19/022; A47C 20/028; A47C 21/006; A47C 17/00; A47C 19/22; A47C 20/04; A47C 21/00; A47C 21/048; A47B 3/00; A47B 23/00; A47B 23/025; Y02B 30/00; A61H 1/00
USPC ..... 5/279.1
See application file for complete search history.

(56) References Cited

U.S. PATENT DOCUMENTS 3,732,860 A * 5/1973 Thurmer ..... A47C 21/006 5/109
3,939,826 A * 2/1976 Fujimoto ..... A61H 23/0254 601/111
4,011,862 A * 3/1977 Kosiak ..... A61H 15/0078 601/99
4,154,232 A * 5/1979 Fukazawa ..... A61H 15/0078 601/102
4,190,043 A * 2/1980 Thompson ..... A61H 1/00 601/99
4,192,296 A * 3/1980 St. Mary ..... A61H 1/00 601/102
4,373,516 A * 2/1983 Masuda ..... A61H 1/00 601/116
4,412,534 A * 11/1983 Hamabe ..... A61H 1/00 601/102
4,469,093 A * 9/1984 Chaplar ..... A61G 13/009 601/111
4,699,126 A * 10/1987 Lancaster ..... A61H 1/00 601/102

(Continued)

FOREIGN PATENT DOCUMENTS

CN 2121934 U * 11/1992 ..... A47C 17/00

*Primary Examiner* — Amber R Anderson
*Assistant Examiner* — Luke Hall
(74) *Attorney, Agent, or Firm* — Zhigang Ma

(57) ABSTRACT

A multifunctional bed includes a bed body, wherein a placement groove is formed in a top of the bed body, and a mattress is arranged inside the placement groove; and a backrest, which is fixedly mounted on one side of the top of the bed body, wherein a user leans against the backrest; a hard mounting frame is fixedly mounted on one side of the backrest; and the same cushion is fixedly mounted between inner walls of two sides of the hard mounting frame.

9 Claims, 7 Drawing Sheets

(56) References Cited

U.S. PATENT DOCUMENTS 4,999,861 A * 3/1991 Huang ..... A61G 7/0573 601/51
5,233,973 A * 8/1993 Gill ..... A61H 1/00 601/99
5,352,186 A * 10/1994 Yamasaki ..... A61H 1/00 601/99
5,505,691 A * 4/1996 Fenkell ..... A61H 1/0222 601/99
5,626,555 A * 5/1997 Di Blasi ..... A61G 7/0573 5/934
5,653,679 A * 8/1997 Belanchi ..... A61H 15/0078 601/134
5,688,228 A * 11/1997 Lin ..... A61H 1/00 601/103
5,741,218 A * 4/1998 Fujii ..... A61H 9/0078 601/99
5,940,911 A * 8/1999 Wang ..... A47C 19/045 5/147
6,117,094 A * 9/2000 Fujii ..... A61H 15/00 601/102
6,190,338 B1 * 2/2001 Arndt ..... A61G 13/009 601/102
6,402,709 B1 * 6/2002 Wu ..... A61H 7/004 601/99
6,723,059 B1 * 4/2004 Park ..... A47C 21/006 5/915
6,890,313 B2 * 5/2005 Kim ..... A61H 15/0078 601/19
7,597,669 B2 * 10/2009 Huang ..... A61H 7/001 601/103
7,976,485 B2 * 7/2011 Huang ..... A61H 15/0078 601/99
9,259,086 B2 * 2/2016 Wong ..... A47C 17/165
9,474,680 B2 * 10/2016 Fitzloff ..... A61H 15/00
10,143,313 B1 * 12/2018 Hunter ..... A47C 21/044
11,013,658 B1 * 5/2021 Brawley ..... A61H 15/0092
11,877,972 B2 * 1/2024 Curry ..... A61H 1/0229
2003/0032903 A1 * 2/2003 Kasai ..... A61H 23/02 601/99
2004/0215113 A1 * 10/2004 Saringer ..... A61G 7/0573 601/103
2005/0229319 A1 * 10/2005 Cho ..... A47C 27/12 5/948
2006/0155223 A1 * 7/2006 Koch ..... A61H 7/00 601/102
2007/0017850 A1 1/2007 Euzen et al.
2008/0236452 A1 * 10/2008 Pratt ..... A47D 5/00 297/118
2008/0262398 A1 * 10/2008 Ferber ..... A61H 7/007 601/98
2011/0214234 A1 9/2011 Herman
2013/0025066 A1 * 1/2013 Shih ..... A47C 21/006 5/694
2014/0041121 A1 * 2/2014 Shan ..... A47C 21/006 5/618
2014/0165291 A1 * 6/2014 Mccarty ..... A61H 23/02 5/658
2015/0067965 A1 3/2015 Xu
2015/0128343 A1 * 5/2015 Katz ..... H04R 1/025 5/279.1
2015/0196129 A1 * 7/2015 Baroni ..... A47C 19/202 5/9.1
2015/0328070 A1 * 11/2015 Tarplee ..... A61H 23/0254 5/616
2016/0361216 A1 * 12/2016 Liu ..... A61G 7/018
2017/0065092 A1 * 3/2017 Fissette ..... A47C 21/006
2017/0319410 A1 * 11/2017 Lee ..... A63B 23/00
2018/0338625 A1 * 11/2018 Nava ..... A47C 19/021
2018/0353374 A1 * 12/2018 Shih ..... A61H 1/005
2019/0151187 A1 * 5/2019 Nagamitsu ..... A61H 1/006
2019/0216680 A1 * 7/2019 Lee ..... A61H 1/00
2019/0388295 A1 * 12/2019 Lim ..... A61H 15/00
2020/0060927 A1 * 2/2020 Bailey ..... A61H 15/00
2020/0170871 A1 * 6/2020 Lukinuk ..... A61H 1/00
2020/0368102 A1 * 11/2020 Shin ..... A61H 7/007
2021/0007502 A1 * 1/2021 Zeng ..... A47C 21/006
2021/0069057 A1 * 3/2021 Watson ..... A61H 15/00
2021/0259431 A1 * 8/2021 Wang ..... A47C 31/008
2021/0282569 A1 * 9/2021 Mao ..... A47C 21/048
2021/0321784 A1 * 10/2021 Freelend ..... A61H 15/0078
2021/0321785 A1 * 10/2021 Wang ..... A47C 21/00
2022/0117401 A1 * 4/2022 Wang ..... A47C 20/041
2022/0167751 A1 * 6/2022 Smith ..... A45C 13/262
2023/0172780 A1 * 6/2023 Chung ..... A61G 7/018 5/616
2024/0023206 A1 * 1/2024 Ock ..... E01C 11/265

* cited by examiner

MULTIFUNCTIONAL BED

TECHNICAL FIELD

The present disclosure relates to the technical field of beds, in particular to, a multifunctional bed.

BACKGROUND

Bedding is an important piece of furniture in life, and has diversified functions. Chinese invention patent No. CN113397337A discloses a multifunctional bed, including a bed body and a mattress. A backrest is fixed to one side of an upper portion of the bed body; low-frequency massage mechanisms are arranged on two sides of a surface of the backrest; pressure sensors are mounted in a placement groove below the mattress at equal intervals; a self-adaptive mechanism is arranged on a surface of the mattress; a constant temperature mechanism is arranged on a surface of the mattress on one side of the self-adaptive mechanism; and a lifting mechanism is arranged on one side below the mattress. This invention realizes a function of facilitating rise and fall of one end of the mattress during use of the bed, a function of massaging the back of a user, a function of making an airbag abutting against the body parts of a user, and a function of adjusting a temperature of a graphene heating pad during the use of the bed.

However, the above patent still has the following problems during use:

1. The above patent can only massage the back of a user. It is inconvenient for the above patent to massage the neck of the user for relaxing while massaging the back of the user, so that the use experience is poor.
2. In the above patent, there is no table board convenient for a user, which makes it inconvenient for the user to sit in the bed for work or it is inconvenient to place items. This patent is not convenient to use.

For the above problems, the present disclosure provides a multifunctional bed.

SUMMARY

The present disclosure provides a multifunctional bed, which solves the shortcomings in the prior art that it is inconvenient to massage the neck of a user and there is no table board convenient to use.

The present disclosure provides the following technical solution:

A multifunctional bed includes:

a bed body, wherein a placement groove is formed in a top of the bed body, and a mattress is arranged inside the placement groove;

a backrest, which is fixedly mounted on one side of the top of the bed body, wherein a user leans against the backrest; a hard mounting frame is fixedly mounted on one side of the backrest; the same cushion is fixedly mounted between inner walls of two sides of the hard mounting frame;

a table board, which is used for providing a place for the user to place items, wherein a bottom of the table board is connected with two second turntables through supporting rods; one side of each of the two second turntables is rotatably connected with a sliding block; first fixed rods are fixedly mounted on two sides of the bed body; the two sliding blocks are slidably connected with the first fixed rods on the two sides separately;

a massage assembly, which is used for massaging the back and neck of the user; and a locking assembly, which is used for locking the table board.

In one possible design, the massage assembly includes a plurality of massage rollers rotatably connected between the inner walls of the two sides of the hard mounting frame; one end of each of the plurality of massage rollers fixedly penetrates through a first gear; the plurality of first gears are meshed with each other; the other end of one of the massage rollers fixedly penetrates through a first synchronizing wheel; a plurality of sliding rods penetrate through one side of the backrest; the same massage cushion is fixedly mounted on one-sides of the plurality of sliding rods; a connecting rod is fixedly mounted at a bottom of one of the sliding rods; the same fixed plate is fixedly mounted between the inner walls of the two sides of the backrest; a motor is fixedly mounted at a top of the fixed plate; an output shaft of the motor is fixedly connected with a double-slot synchronizing wheel through a rotating shaft; the double-slot synchronizing wheel is in drive connection with the first synchronizing wheel through a synchronous belt; the double-slot synchronizing wheel is in drive connection with a second synchronizing wheel through another synchronous belt; the second synchronizing wheel is rotatably connected with the inner wall of one side of the backrest through a rotating shaft; the other end of the rotating shaft is fixedly connected with a first turntable; a fixed column is fixedly mounted at a position, deviating from a circle center, on one side of the first turntable; and the fixed column is slidably connected with the connecting rod through a sliding chute.

In one possible design, the locking assembly includes a second gear fixedly connected to the second turntable on one side; the second gear is in clamping connection with a gear slot seat; a second fixed rod penetrates through the gear slot seat, the second gear, and the second turntable; one end of the second fixed rod is fixedly connected with the sliding blocks; the other end of the second fixed rod is fixedly connected with a limiting shell; an outer wall of the second fixed rod is sleeved with a pressure spring; one end of the pressure spring is fixedly connected with one side of the gear slot seat; the other end of the pressure spring is fixedly connected with an inner wall of one side of the limiting shell; two deflector rods are fixedly mounted on a circumferential outer wall of the gear slot seat; two limiting sliding holes are formed in a circumferential outer wall of the limiting shell; and the two deflector rods are respectively slidably connected with the two limiting sliding holes.

Further, an electric telescopic rod is fixedly embedded at the top of the bed body; an output shaft of the electric telescopic rod is fixedly provided with a push plate; the push plate resists against a bottom of the mattress; a limiting block is fixedly mounted at the bottom of the mattress; and the push plate cooperates with the limiting block.

Further, a heating module is fixedly embedded in a top of the mattress; and a graphene heat-conducting plate is fixedly mounted at a top of the heating module.

Further, a circuit board is fixedly mounted at the bottom of the bed body; and the circuit board is electrically connected with the electric telescopic rod, the motor, and the heating module.

Further, a groove for accommodating the push plate and the limiting block is formed in a bottom inner wall of the placement groove.

Further, the first synchronizing wheel and the plurality of first gears are separately located in hard compartments on the two sides of the hard mounting frame.

In the present disclosure, when a user needs massage, the user can push the deflector rods to separate the gear slot seat from the second gear, so that the second turntable can be rotated at this time to lift up the table board. After the user stops pushing the deflector rods, the gear slot seat is clamped with the second gear to fix the table board. Since the sliding blocks slide on the first fixed rods, the table board can then be moved from a bed end to a desired position, which facilitates angle and position adjustment and use.

In the present disclosure, the back and neck of the user can be massaged at the same time; the massage effect is good; the fatigue of the user can be relieved; the mobile table board that is convenient for angle adjustment is also arranged; meanwhile, when not in use, the table board can be stored in the bed end, which will not occupy a relatively large space and is convenient to use; and in addition, when the user lies down, the head of the user can be raised, and the feet can be heated. Therefore, the use experience is better.

DETAILED DESCRIPTION OF THE EMBODIMENTS

Figure 1:
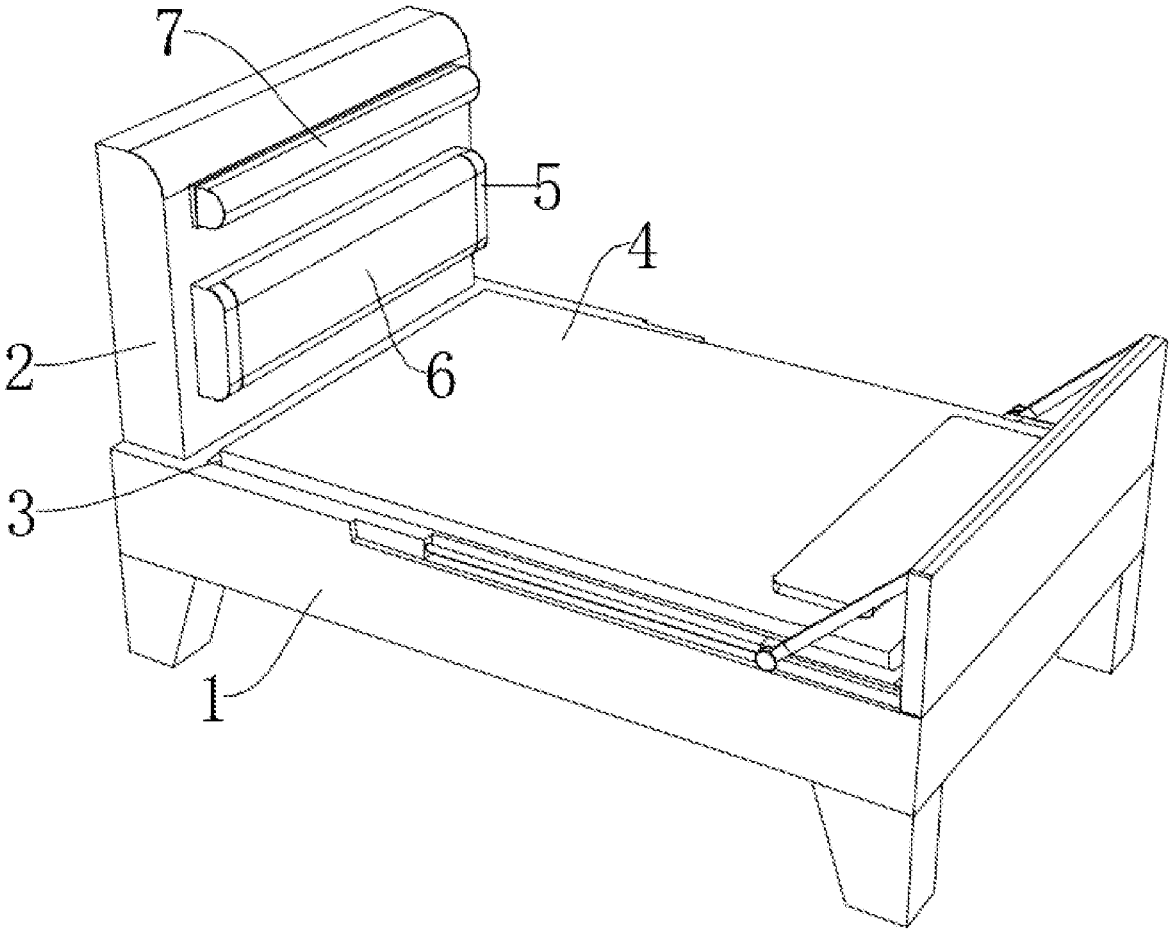
FIG. 1 is a schematic diagram of a three-dimensional structure of a multifunctional bed provided according to an embodiment of the present disclosure.

The embodiments of the present disclosure are described below in combination with the accompanying drawings.

Embodiment 1

Referring to FIG. 1 to FIG. 7, a multifunctional bed includes:

a bed body 1, wherein a placement groove 3 is formed in a top of the bed body 1, and a mattress 4 is arranged inside the placement groove 3;

a backrest 2, which is fixedly mounted on one side of the top of the bed body 1, wherein a user leans against the backrest 2; a hard mounting frame 5 is fixedly mounted on one side of the backrest 2; the same cushion 6 is fixedly mounted between inner walls of two sides of the hard mounting frame 5;

a table board 27, which is used for providing a place for the user to place items, wherein a bottom of the table board 27 is connected with two second turntables 28 through supporting rods; one side of each of the two second turntables 28 is rotatably connected with a sliding block 26; first fixed rods 25 are fixedly mounted on two sides of the bed body 1; the two sliding blocks 26 are slidably connected with the first fixed rods 25 on the two sides separately;

a massage assembly, which is used for massaging the back and neck of the user; and a locking assembly, which is used for locking the table board 27.

In the above technical solution, a multifunctional bed that is convenient to use can be achieved. The multifunctional bed can massage the back and neck of a user. In addition, the mobile table board that is convenient to store is also convenient for angle adjustment, so that the use experience is relatively good.

Referring to FIG. 1, FIG. 2, FIG. 3, and FIG. 4, in this embodiment, the massage assembly includes a plurality of massage rollers 8 rotatably connected between the inner walls of the two sides of the hard mounting frame 5. One end of each of the plurality of massage rollers 8 fixedly penetrates through a first gear 18. The plurality of first gears 18 are meshed with each other. The other end of one of the massage rollers 8 fixedly penetrates through a first synchronizing wheel 21. A plurality of sliding rods 9 penetrate through one side of the backrest 2. The same massage cushion 7 is fixedly mounted on one-sides of the plurality of sliding rods 9. A connecting rod 10 is fixedly mounted at a bottom of one of the sliding rods 9. The same fixed plate 17 is fixedly mounted between the inner walls of the two sides of the backrest 2. A motor 19 is fixedly mounted at a top of the fixed plate 17. An output shaft of the motor 19 is fixedly connected with a double-slot synchronizing wheel 20 through a rotating shaft. The double-slot synchronizing wheel 20 is in drive connection with the first synchronizing wheel 21 through a synchronous belt. The double-slot synchronizing wheel 20 is in drive connection with a second synchronizing wheel 22 through another synchronous belt. The second synchronizing wheel 22 is rotatably connected with the inner wall of one side of the backrest 2 through a rotating shaft. The other end of the rotating shaft is fixedly connected with a first turntable 23. A fixed column 24 is fixedly mounted at a position, deviating from a circle center, on one side of the first turntable 23. The fixed column 24 is slidably connected with the connecting rod 10 through a sliding chute.

In the above technical solution, the back and neck of the user can be massaged at the same time, so that the massage effect is good, and the user experience is better.

Figure 6:
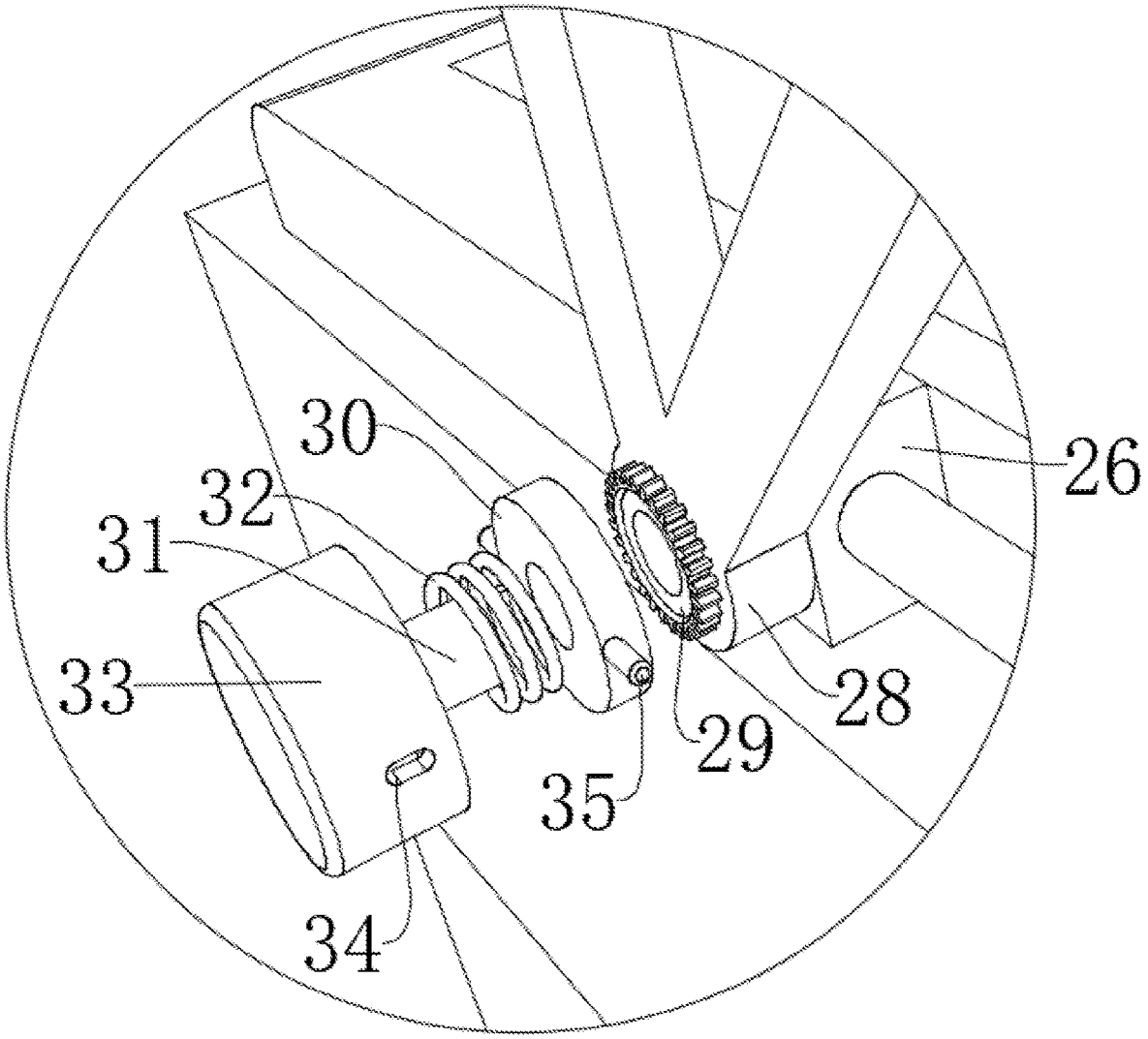
FIG. 6 is a schematic structural diagram of a locking assembly of a multifunctional bed provided according to an embodiment of the present disclosure.
Figure 7:
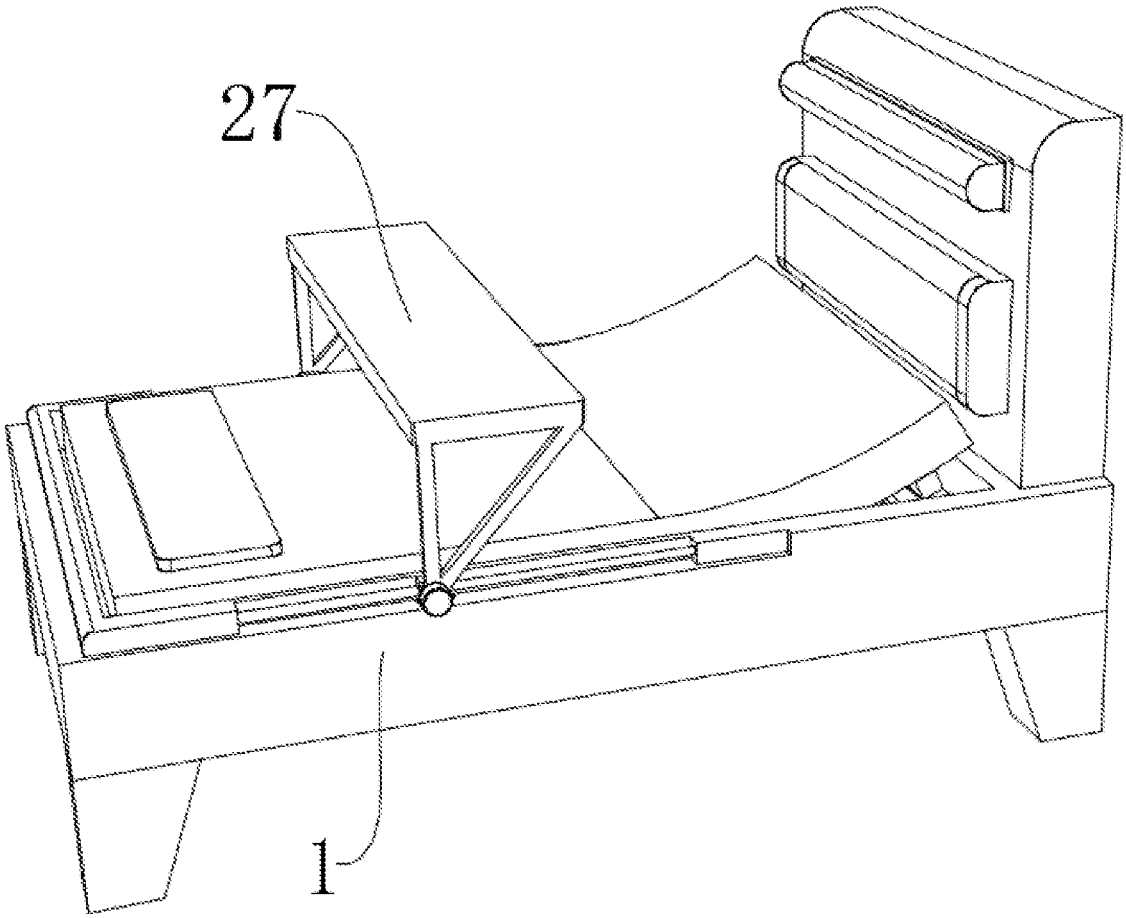
FIG. 7 is a schematic structural diagram of a moving state of a table board of a multifunctional bed provided according to an embodiment of the present disclosure.

Referring to FIG. 6, in this embodiment, the locking assembly includes a second gear 29 fixedly connected to the second turntable 28 on one side. The second gear 29 is in clamping connection with a gear slot seat 30. A second fixed rod 31 penetrates through the gear slot seat 30, the second gear 29, and the second turntable 28. One end of the second fixed rod 31 is fixedly connected with the sliding blocks 26. The other end of the second fixed rod 31 is fixedly connected with a limiting shell 33. An outer wall of the second fixed rod 31 is sleeved with a pressure spring 32. One end of the pressure spring 32 is fixedly connected with one side of the gear slot seat 30. The other end of the pressure spring 32 is fixedly connected with an inner wall of one side of the limiting shell 33. Two deflector rods 35 are fixedly mounted on a circumferential outer wall of the gear slot seat 30. Two limiting sliding holes 34 are formed in a circumferential outer wall of the limiting shell 33. The two deflector rods 35 are respectively slidably connected with the two limiting sliding holes 34.

In the above technical solution, angle adjustment and fixing can be performed on the table board 27, which facilitates use by the user.

Embodiment 2

Figure 2:
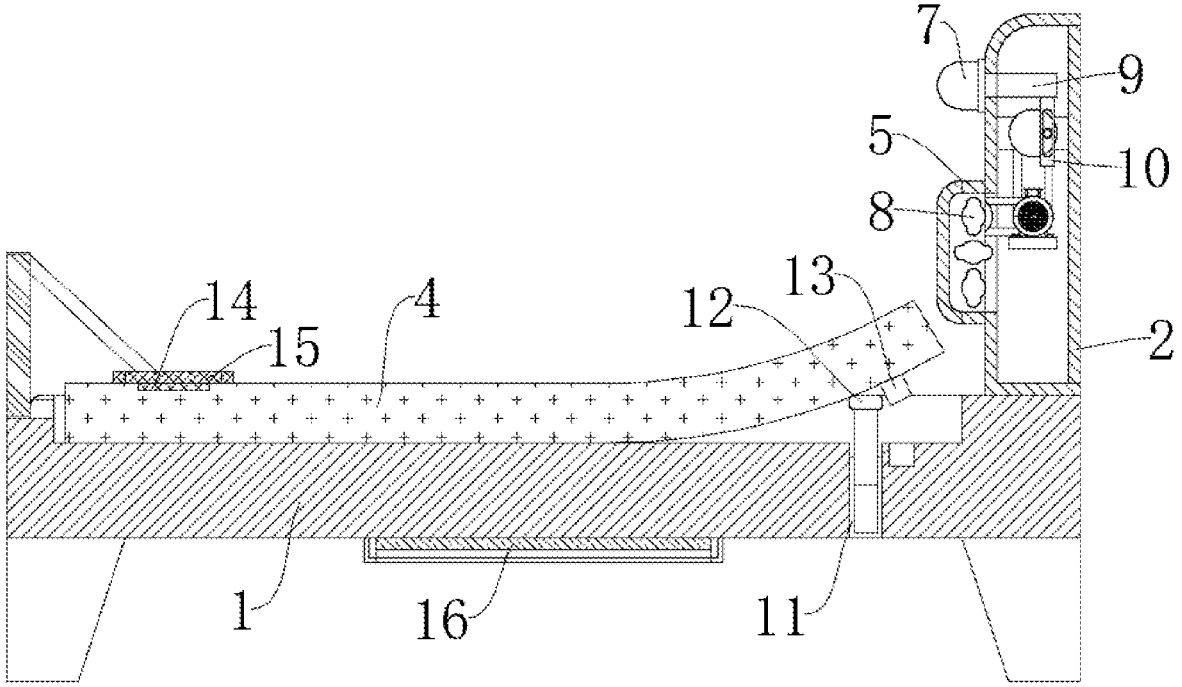
FIG. 2 is a schematic diagram of a side sectional structure of a multifunctional bed provided according to an embodiment of the present disclosure.

Referring to FIG. 2, this embodiment has a difference that an electric telescopic rod 11 is fixedly embedded at the top of the bed body 1. An output shaft of the electric telescopic rod 11 is fixedly provided with a push plate 12. The push plate 12 resists against a bottom of the mattress 4. A limiting block 13 is fixedly mounted at the bottom of the mattress 4. The push plate 12 cooperates with the limiting block 13.

In the above technical solution, one end of the mattress 4 can be raised, which is convenient for raising the head of the user, so that the sleep experience is better.

In this embodiment, a heating module 14 is fixedly embedded in a top of the mattress 4. A graphene heat-conducting plate 15 is fixedly mounted at a top of the heating module 14.

In the above technical solution, the feet of the user can be heated during use of the bed, so that the use experience is better.

In this embodiment, a circuit board 16 is fixedly mounted at the bottom of the bed body 1. The circuit board 16 is electrically connected with the electric telescopic rod 11, the motor 19, and the heating module 14. The circuit board 16 and the heating module 14 are both the same as those in the Chinese invention patent No. CN113397337A.

In the above technical solution, the electric telescopic rod 11, the motor 19, and the heating module 14 can be uniformly controlled, which are convenient to use.

In this embodiment, a groove for accommodating the push plate 12 and the limiting block 13 is formed in a bottom inner wall of the placement groove 3.

In the above technical solution, it is convenient for horizontally placing the mattress 4.

Figure 3:
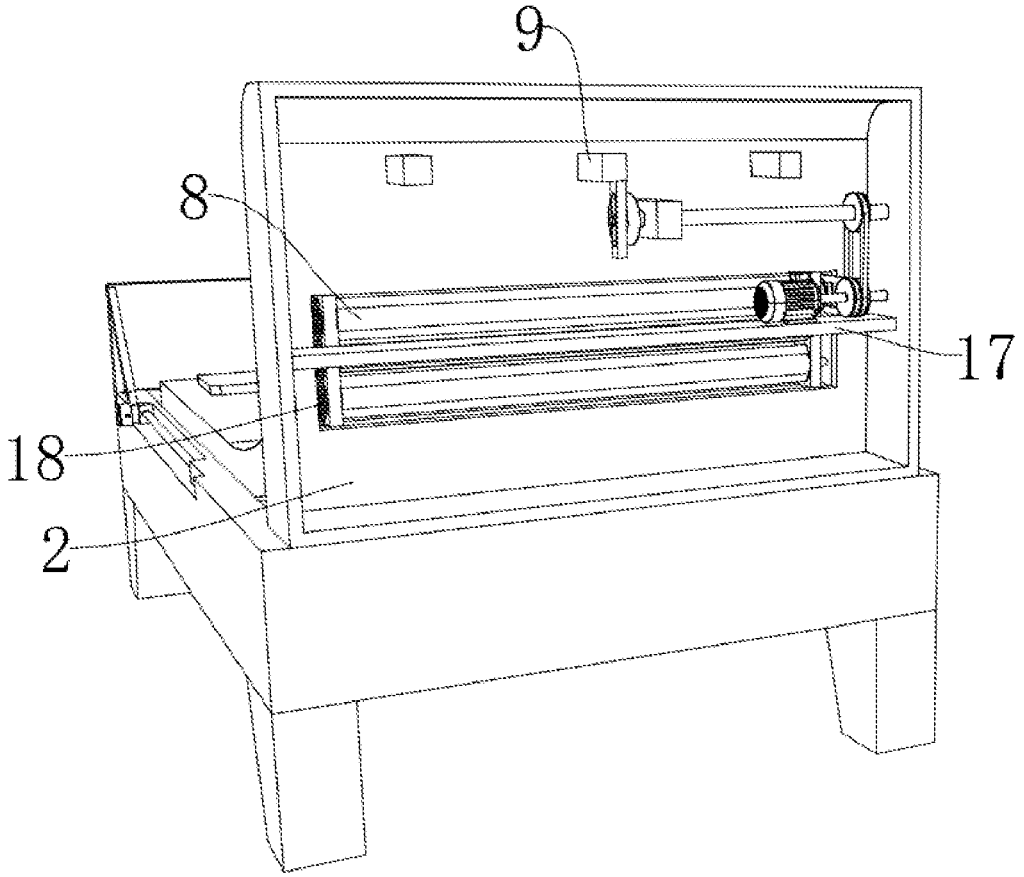
FIG. 3 is a schematic diagram of an internal structure of a backrest of a multifunctional bed provided according to an embodiment of the present disclosure.
Figure 4:
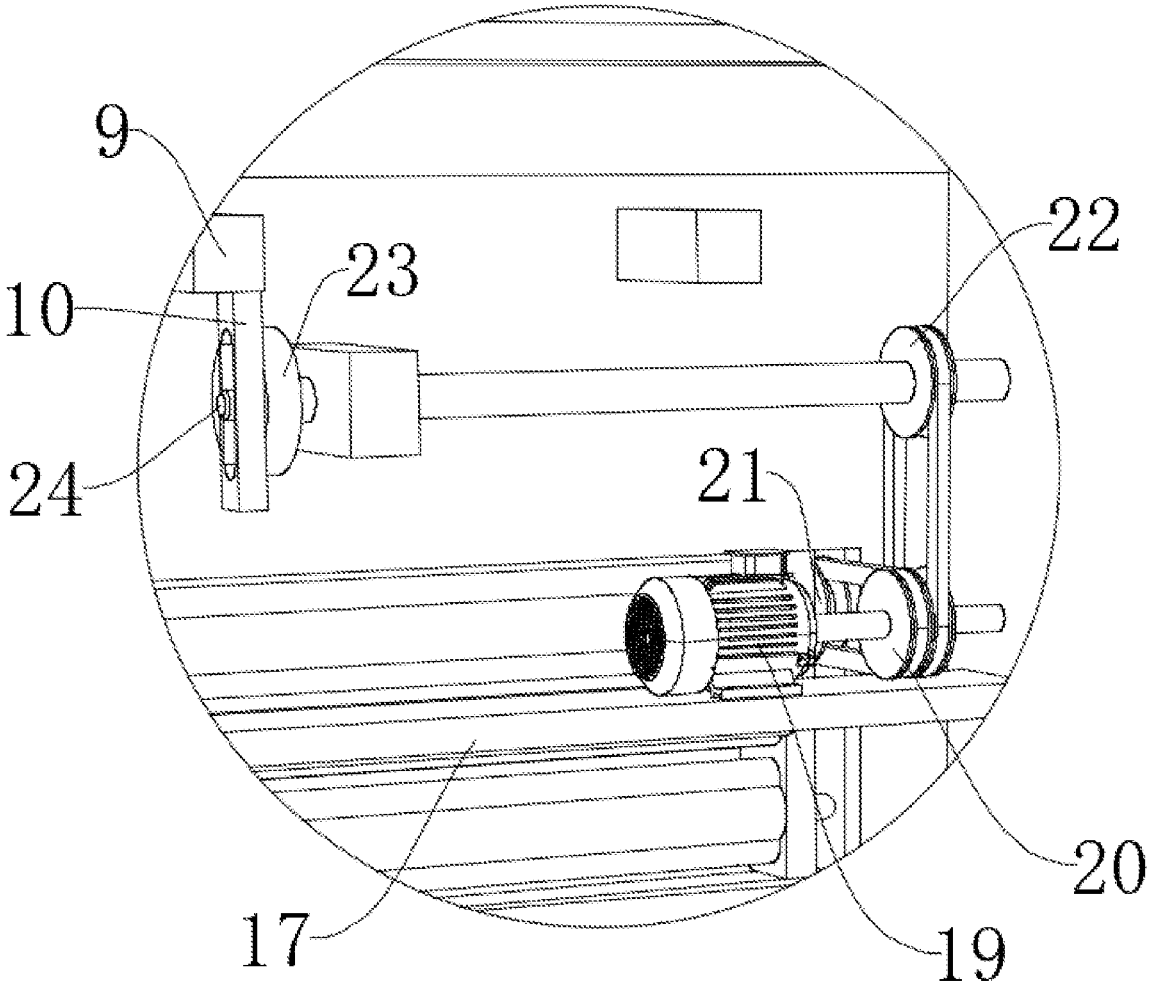
FIG. 4 is a schematic structural diagram of an actuation portion of a massage assembly of a multifunctional bed provided according to an embodiment of the present disclosure.
Figure 5:
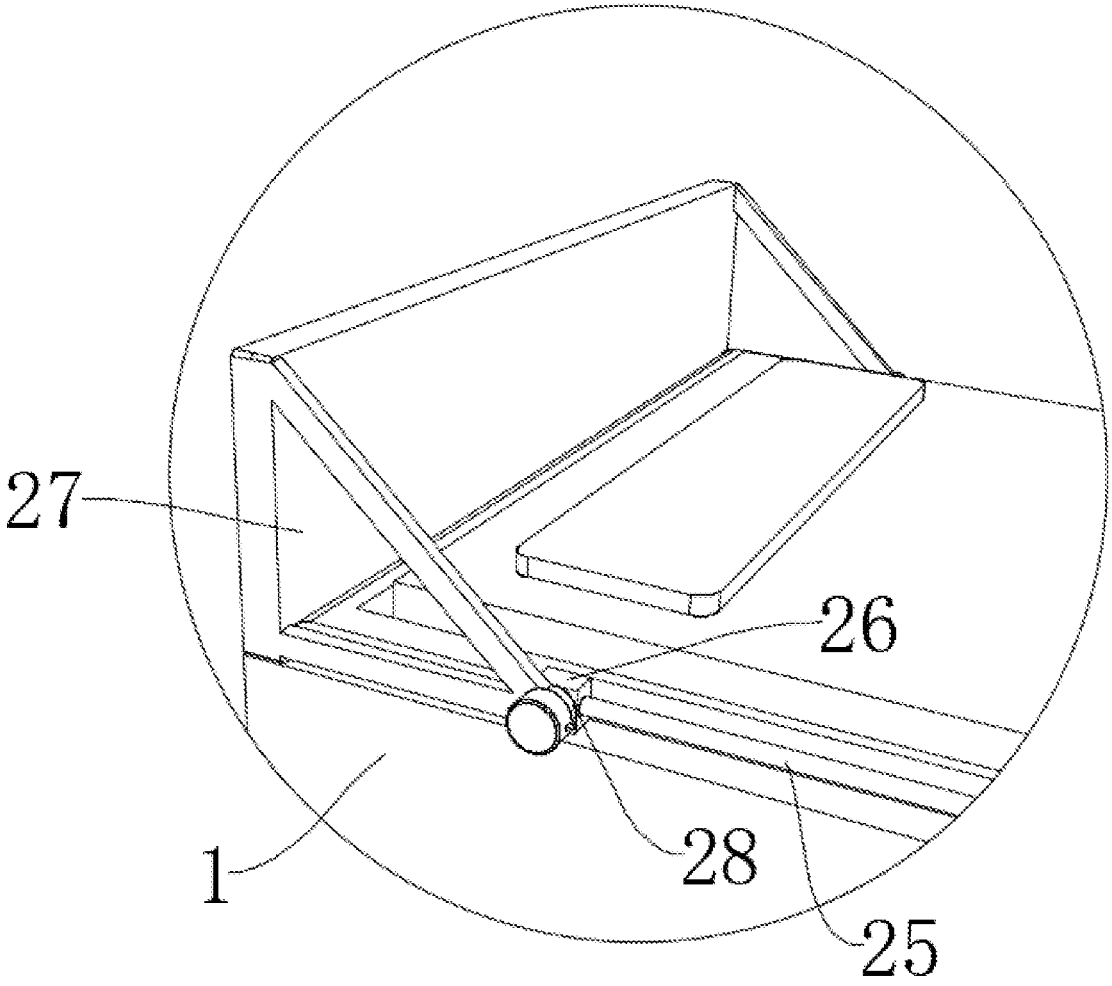
FIG. 5 is a schematic structural diagram of a table board of a multifunctional bed provided according to an embodiment of the present disclosure.

Referring to FIG. 1 and FIG. 3, in this embodiment, the first synchronizing wheel 21 and the plurality of first gears 18 are separately located in hard compartments on the two sides of the hard mounting frame 5.

In the above technical solution, injury to the user caused by rotation of the gears and the synchronizing wheels can be avoided.

However, as is well known to those skilled in the art, the working principles and wiring methods of the electric telescopic rod, the motor, and the heating module are common and all belong to conventional methods or common knowledge, and will not be repeated here. Those skilled in the art can make any selection according to their needs or convenience.

A working principle and use process of the technical solution is as follows. During use, when a user sits in the bed, the user can lean against the cushion 6 with the back and abut against the massage cushion 7 with the neck. At this time, the motor 19 is turned on. The massage rollers 8 can be driven by the synchronizing wheels to rotate. The plurality of first gears 18 are meshed with each other, so that all the massage rollers 8 can rotate. Massage convex bars arranged on outer walls of the massage rollers 8 can continuously massage the back of the user. At the same time, the double-slot synchronizing wheel 20 can also drive the second synchronizing wheel 22 to rotate, thereby driving the first turntable 23 to start to rotate. The fixed column 24 slides in the sliding chute in the connecting rod 10, so that the sliding rods 9 can continuously do a reciprocating motion in a direction perpendicular to the backrest 2, to make the massage cushion 7 extend and contract, which can continuously push and massage the neck of the user to relieve the fatigue of the user. When the user needs massage, the user can push the deflector rods 35 to separate the gear slot seat 30 from the second gear 29, so that the second turntable 28 can be rotated at this time to lift up the table board 27. After the user stops pushing the deflector rods 35, the gear slot seat 30 is clamped with the second gear 29 to fix the table board 27. Since the sliding blocks 26 slide on the first fixed rods 25, the table board 27 can then be moved from a bed end to a desired position, to facilitate angle and position adjustment and use. The heating module 14 can heat the graphene heat-conducting plate 15, and the graphene heat-conducting plate 15 can quickly conduct the heat, to make the user have a more comfortable sleep experience. The electric telescopic rod 11 is turned on to push out the push plate 12. The push plate 12 may squeeze the bottom of the mattress 4 to raise one end of the mattress 4. The push plate 12 can also be avoided from sliding out under the limitation of the limiting block 13, so that it is convenient to raise the head of the user, to improve the use experience.

It should be understood that those of ordinary skill in the art can make improvements or transformations according to the above illustrations, and all these improvements and transformations shall fall within the protection scope of the claims appended.

What is claimed is:

1. A multifunctional bed, comprising:

a bed body, wherein a placement groove is formed in a top of the bed body, and a mattress is arranged inside the placement groove;

a backrest, which is fixedly mounted on one side of the top of the bed body, wherein the backrest is configured to support a leaning user; a hard mounting frame is fixedly mounted on one side of the backrest; a cushion is fixedly mounted between inner walls of two sides of the hard mounting frame;

a table board, which is configured to provide a place for the user to place items, wherein a bottom of the table board is connected with two second turntables through supporting rods; one side of each of the two second turntables is rotatably connected with a sliding block; first fixed rods are fixedly mounted on two sides of the bed body; the two sliding blocks are slidably connected with the first fixed rods on the two sides separately;

a massage assembly, which is used for massaging the back and neck of the user; and a locking assembly, which is used for locking the table board;

wherein the massage assembly comprises a motor, and a plurality of massage rollers and a massage cushion driven by the motor, the massage rollers are rotatably connected between inner walls of two sides of the hard mounting frame, the massage rollers have massage convex bars arranged on outer walls thereof to continuously massage the back of the user; one end of each of the plurality of massage rollers fixedly penetrates through a first gear; the plurality of first gears are meshed with each other; the other end of one of the massage rollers fixedly penetrates through a first synchronizing wheel;

a plurality of sliding rods penetrate through one side of the backrest; the massage cushion is fixedly mounted on one-sides of the plurality of sliding rods, the sliding rods are in drive connection with a second synchronizing wheel, and the first synchronizing wheel and the second synchronizing wheel are in drive connection with an output shaft of the motor, the sliding rods are capable of continuously doing a reciprocating motion in a direction perpendicular to the backrest, to make the massage cushion extend and contract to push and massage the neck of the user.

2. The multifunctional bed according to claim 1, wherein a connecting rod is fixedly mounted at a bottom of one of the sliding rods; a fixed plate is fixedly mounted between the inner walls of the two sides of the backrest; a motor is fixedly mounted at a top of the fixed plate; an output shaft of the motor is fixedly connected with a double-slot synchronizing wheel through a rotating shaft; the double-slot synchronizing wheel is in drive connection with the first synchronizing wheel through a synchronous belt; the double-slot synchronizing wheel is in drive connection with the second synchronizing wheel through another synchronous belt; the second synchronizing wheel is rotatably connected with the inner wall of one side of the backrest through a rotating shaft; the other end of the rotating shaft is fixedly connected with a first turntable; a fixed column is fixedly mounted at a position, deviating from a circle center, on one side of the first turntable; and the fixed column is slidably connected with the connecting rod through a sliding chute.

3. The multifunctional bed according to claim 1, wherein the locking assembly comprises a second gear fixedly connected to one of the second turntables on one side; the second gear is in clamping connection with a gear slot seat; a second fixed rod penetrates through the gear slot seat, the second gear, and the second turntable; one end of the second fixed rod is fixedly connected with the sliding blocks; the other end of the second fixed rod is fixedly connected with a limiting shell; an outer wall of the second fixed rod is sleeved with a pressure spring; one end of the pressure spring is fixedly connected with one side of the gear slot seat; the other end of the pressure spring is fixedly connected with an inner wall of one side of the limiting shell; two deflector rods are fixedly mounted on a circumferential outer wall of the gear slot seat; two limiting sliding holes are formed in a circumferential outer wall of the limiting shell; and the two deflector rods are respectively slidably connected with the two limiting sliding holes.

4. The multifunctional bed according to claim 1, wherein an electric telescopic rod is fixedly embedded at the top of the bed body; an output shaft of the electric telescopic rod is fixedly provided with a push plate; the push plate is configured to resist against a bottom of the mattress; a limiting block is fixedly mounted at the bottom of the mattress; and the push plate is configured to cooperate with the limiting block.

5. The multifunctional bed according to claim 4, wherein a heating module is fixedly embedded in a top of the mattress; and a graphene heat-conducting plate is fixedly mounted at a top of the heating module.

6. The multifunctional bed according to claim 5, wherein a circuit board is fixedly mounted at a bottom of the bed body; and the circuit board is electrically connected with the electric telescopic rod, the motor, and the heating module.

7. The multifunctional bed according to claim 4, wherein a groove for accommodating the push plate and the limiting block is formed in a bottom inner wall of the placement groove.

8. The multifunctional bed according to claim 2, wherein the first synchronizing wheel and the plurality of first gears are separately located in hard compartments on the two sides of the hard mounting frame.

9. A multifunctional bed, comprising:

a bed body, wherein a placement groove is formed in a top of the bed body, and a mattress is arranged inside the placement groove;

a backrest, which is fixedly mounted on one side of the top of the bed body, wherein the backrest is configured to support a leaning user; a hard mounting frame is fixedly mounted on one side of the backrest; a back cushion is fixedly mounted between inner walls of two sides of the hard mounting frame;

a massage assembly, which is used for massaging the back and neck of the user;

wherein the massage assembly comprises a motor, and a plurality of massage rollers and a massage cushion, the massage rollers are rotatably connected between inner walls of two sides of the hard mounting frame, the massage rollers have massage convex bars arranged on outer walls thereof to continuously massage the back of the user through the back cushion; one end of each of the plurality of massage rollers fixedly penetrates through a first gear; the plurality of first gears are meshed with each other; the other end of one of the massage rollers fixedly penetrates through a first synchronizing wheel;

a plurality of sliding rods penetrate through one side of the backrest; the massage cushion is spaced from the back cushion and is fixedly mounted on one-sides of the plurality of sliding rods, the sliding rods are in drive connection with a second synchronizing wheel, and the first synchronizing wheel and the second synchronizing wheel are in drive connection with an output shaft of the motor, the sliding rods are capable of continuously doing a reciprocating motion in a direction perpendicular to the backrest, to make the massage cushion extend and contract to push and massage the neck of the user.

* * * * *